US005499486A

United States Patent [19]

Kimoto et al.

[11] Patent Number: 5,499,486

[45] Date of Patent: Mar. 19, 1996

[54] PROCESS FOR PACKING ELECTROPHOTOGRAPHIC PHOTORECEPTOR

[75] Inventors: Keizo Kimoto; Yasuyuki Hanatani; Hiroaki Sakai; Tsuneo Oki; Mamoru Uemura, all of Osaka, Japan

[73] Assignee: Mita Industrial Co., Ltd., Osaka, Japan

[21] Appl. No.: 345,384

[22] Filed: Nov. 18, 1994

[30] Foreign Application Priority Data

Nov. 29, 1993 [JP] Japan ..... 5-298674

[51] Int. Cl.[6] ..... B65B 11/48; B65B 19/34; B65B 25/00

[52] U.S. Cl. ..... 53/465; 53/399; 53/461; 53/590; 206/446

[58] Field of Search ..... 53/461, 465, 399, 53/397, 396, 214, 211, 210, 216, 587, 590; 206/446, 410, 400, 389

[56] References Cited

U.S. PATENT DOCUMENTS 2,889,672 6/1959 Anderson ..... 53/465 X
2,996,179 8/1961 Osterman ..... 206/410
4,555,023 11/1985 Sykes et al. ..... 206/446
4,860,898 8/1989 Hiro et al. ..... 206/410 X
4,903,834 2/1990 Akao et al. ..... 206/410

FOREIGN PATENT DOCUMENTS 2220382 1/1990 United Kingdom .

OTHER PUBLICATIONS

Patent Abstracts of Japan to Sakai, vol. 10, No. 334 (P–515) (2390) dated Nov. 13, 1986.
Patent Abstracts of Japan to Miura, vol. 7, No. 42 (P–177) (1187) dated Feb. 19, 1983.

*Primary Examiner*—James F. Coan
*Attorney, Agent, or Firm*—Beveridge, DeGrandi, Weilacher & Young

[57] ABSTRACT

The present invention provides a process for packing a drum-shaped electrophotographic photoreceptor comprising the steps of folding a wrapping-start edge portion of a light-shielding packing sheet outwardly in a diametrical direction of the photoreceptor across a width of the packing sheet, and wrapping the packing sheet on a circumferential surface of the photoreceptor. The packing process of the present invention enables an electrophotographic photoreceptor, which has a small diameter, or has a soft surface and is susceptible to scratching, to be packed without forming scratches on its surface and decreasing its photosensitivity.

5 Claims, 5 Drawing Sheets

FIG. 3(a')

PROCESS FOR PACKING ELECTROPHOTOGRAPHIC PHOTORECEPTOR

BACKGROUND OF THE INVENTION

The present invention relates to processes for packing a drum-shaped electrophotographic photoreceptor for transportation and storage by wrapping its circumferential surface in a packing sheet such as a black paper.

Conventionally, the packing of a drum-shaped electrophotographic photoreceptor for transportation and storage is achieved by wrapping its circumferential surface in a light-shielding packing sheet such as a black paper and further wrapping the packing sheet in a cushioning material.

In recent years, there has occurred image defects due to scratches formed on the surface of an electrophotographic photoreceptor by an edge portion of a packing sheet especially at the time of its unpacking. Such scratches cause black and/or white lines appearing in a formed image on the portions corresponding to the scratches formed on the photoreceptor. This tendency is aggravated, as image forming apparatus such as electrostatic copying machines become downsized and, at the same time, the diameter of electrophotographic photoreceptors installed therein is decreased.

Conventionally, a relatively thick packing sheet has been tightly wrapped the surface of an electrophotographic photoreceptor in order to perfectly shield the photoreceptor from light. However, if an electrophotographic photoreceptor with a smaller diameter is packed in the conventional way, the packing sheet is warped, and an edge portion of the warped packing sheet scratches the surface of the electrophotographic photoreceptor, particularly when it is unpacked.

For example, when an electrophotographic photoreceptor D is unpacked by removing a packing sheet 1' in a circumferential direction of the photoreceptor D as shown by a white arrow in FIG. 3(*a*), a wrapping-start edge portion 1*a'* of the packing sheet 1' scratches the surface of the photoreceptor D in a circumferential direction thereof as shown by a black arrow in a fragmentary enlarged view of FIG. 3(*a*), thereby forming scratches K1 on the surface of the photoreceptor D in a circumferential direction thereof as shown in FIG. 3(*b*).

When the electrophotographic photoreceptor D is unpacked by drawing out the packing sheet 1' in an axial direction of the photoreceptor D as shown by a white arrow in FIG. 4(*a*), the wrapping-start edge portion 1*a'* of the packing sheet 1' scratches the surface of the photoreceptor D along a contact line, thereby forming a scratch K2 on the surface of the photoreceptor D along the contact line as shown in FIG. 4(*b*).

Such scratches are noticeable in photoreceptors such as selenium-tellurium (Se-Te) photoreceptors and organic photoreceptors, whose surface hardness are relatively low, i.e., a Vicker's hardness of 45 or less.

To solve the above problem, thin sheet materials which are relatively flexible and insusceptible to warping or synthetic papers which are insusceptible to warping may be employed as a packing sheet. However, the former have insufficient light-shielding properties and, therefore, the photosensitivity of the photoreceptor may decrease. The latter mainly comprise a resin, and the resin contains a plasticizer and a residual solvent or the like. Such ingredients may change electric characteristics of the photoreceptor, thus lowing the electric charge characteristics or the photosensitivity.

SUMMARY OF THE INVENTION

It is a principal object of the present invention to provide a process for packing a small-diameter electrophotographic photoreceptor without forming scratches on the surface thereof nor decreasing the photosensitivity.

In the process of the present invention, a wrapping-start edge portion of a light-shielding packing sheet is folded outwardly in a diametrical direction of the electrophotographic photoreceptor across the width of the packing sheet when wrapping its circumferential surface in the packing sheet.

In accordance with the process, the wrapping-start edge portion of the packing sheet is folded outwardly across the width of the packing sheet, so that an R-shaped crease of the packing sheet, which is not an acute angle of a sharp edge portion, contacts the photoreceptor. Therefore, even if the photoreceptor is packed in a relatively thick packing sheet presenting a sufficient light-shielding properties, the surface of the photoreceptor is free from scratches which may be formed at the time of unpacking.

Accordingly, this process is particularly valid for electrophotographic photoreceptors with a small diameter, and realizes their packing avoiding scratches and the decrease in photosensitivity.

Packing sheets used in the present invention preferably have an opacity in a range between about 90% and 100% which is obtained from the following equation:

$$\text{Opacity (\%)} = \frac{R_W}{R_B} \times 100$$

where $R_W$ and $R_B$ are reflection densities of a packing sheet placed on white and black backgrounds, respectively.

Packing sheets that satisfy the aforesaid requirement include a black paper having a thickness of 0.08 mm to 0.3 mm.

Packing sheets with a high opacity such as the aforesaid black paper are excellent in light-shielding properties, thus ensuring that the photosensitivity of a photoreceptor does not decrease.

The packing process of the present invention is applicable to photoreceptors whose surface are soft and susceptible to scratches, exhibiting a relatively low surface hardness, that is, a Vicker's hardness of 45 or less, or those having a relatively small diameter of 40 mmϕ or less, by which a packing sheet is easy to warp.

DETAILED DESCRIPTION OF THE INVENTION

The process for packing an electrophotographic photoreceptor of the present invention will be hereinafter described with reference to the accompanying drawings in which an exemplary packing process is illustrated.

Figure 1A:
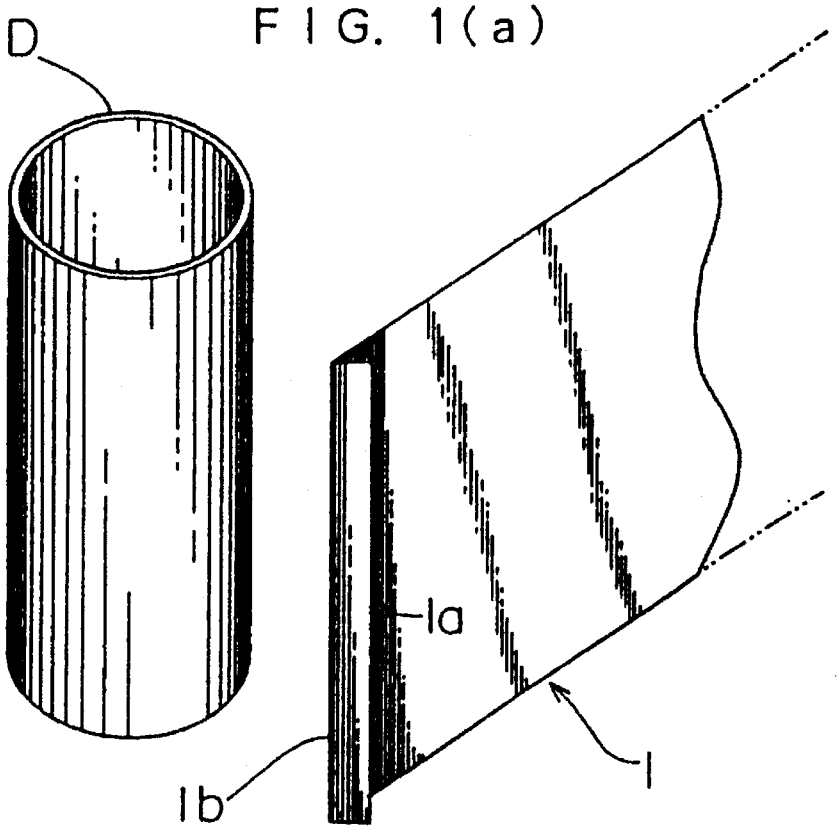
FIG. 1(*a*) is a perspective view illustrating a state in which a wrapping-start edge portion of a packing sheet is folded in one step of a process for packing electrophotographic photoreceptor in the present invention, and FIG. 1(*b*) is a perspective view illustrating a state in which the packing sheet is wrapped around the photoreceptor with the edge portion of the packing sheet being outwardly folded in another step of the packing process.
Figure 1B:
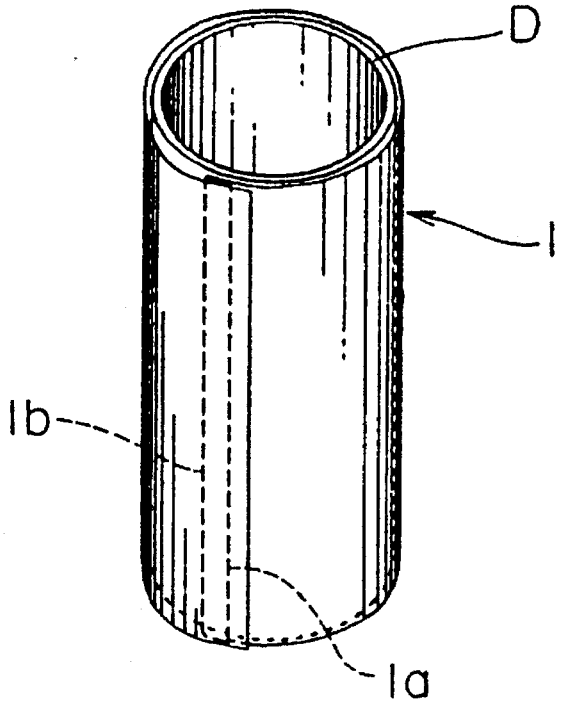
Figure 2:
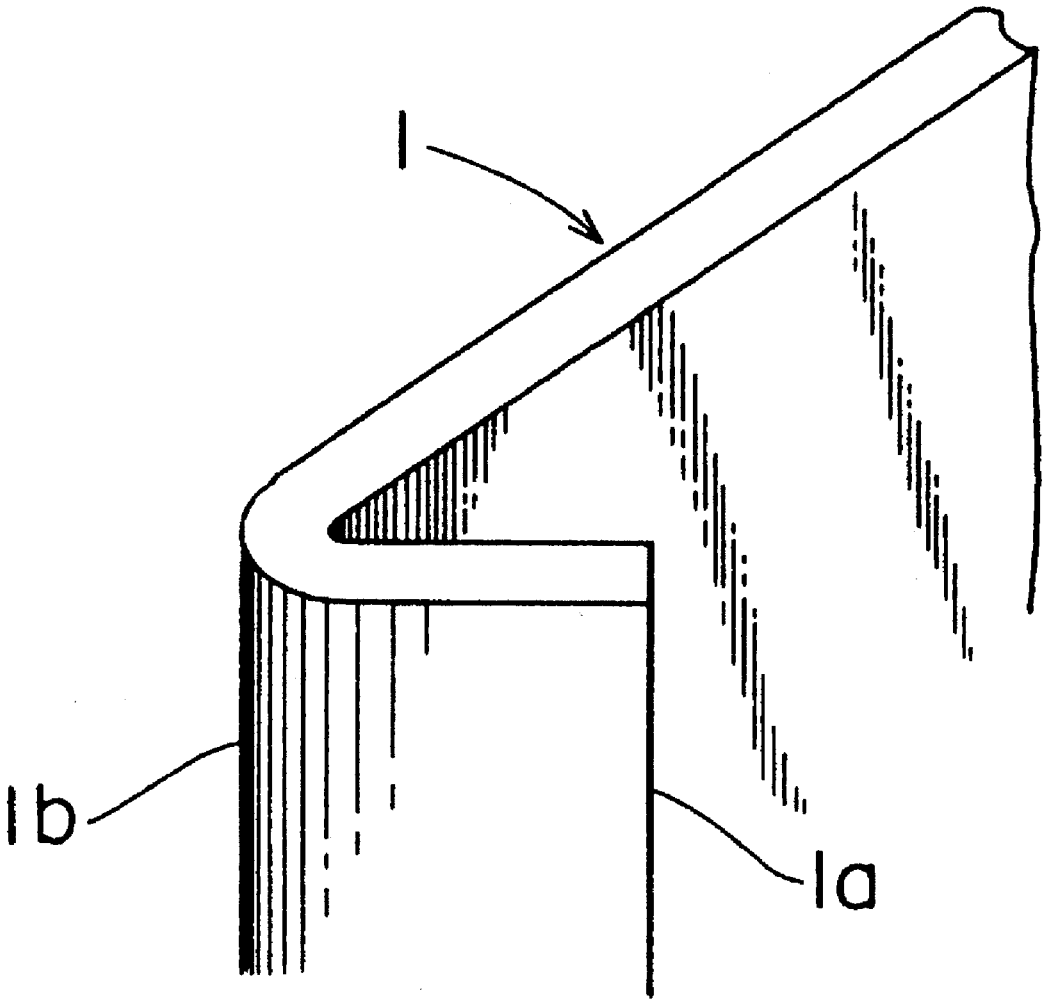
FIG. 2 is an enlarged fragmentary view in perspective illustrating a folded edge portion of a packing sheet.
Figure 3A:
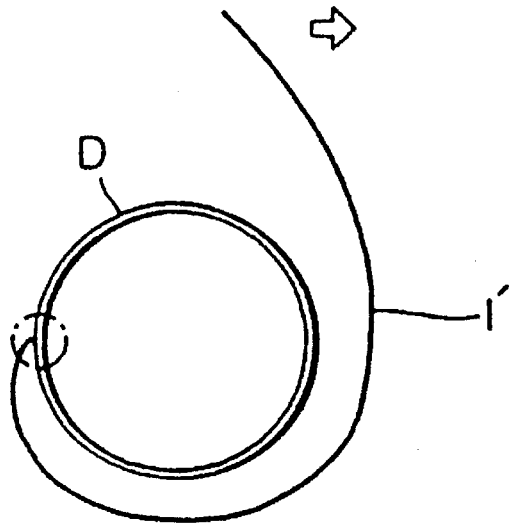
FIG. 3(*a*) is a plan view illustrating an unpacking process in which a packing sheet wrapped around a photoreceptor with the edge portion thereof being unfolded is removed from the photoreceptor in a circumferential direction of the photoreceptor, FIG. 3(*a'*) is an enlarged plan view of the wrapper edge contacting the photoreceptor, and FIG. 3(*b*) is a perspective view illustrating the photoreceptor whose surface is scratched by the packing sheet in the unpacking process.
Figure 3A:
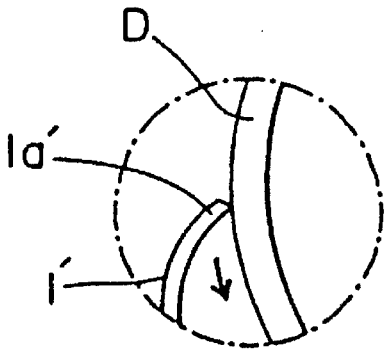
Figure 3B:
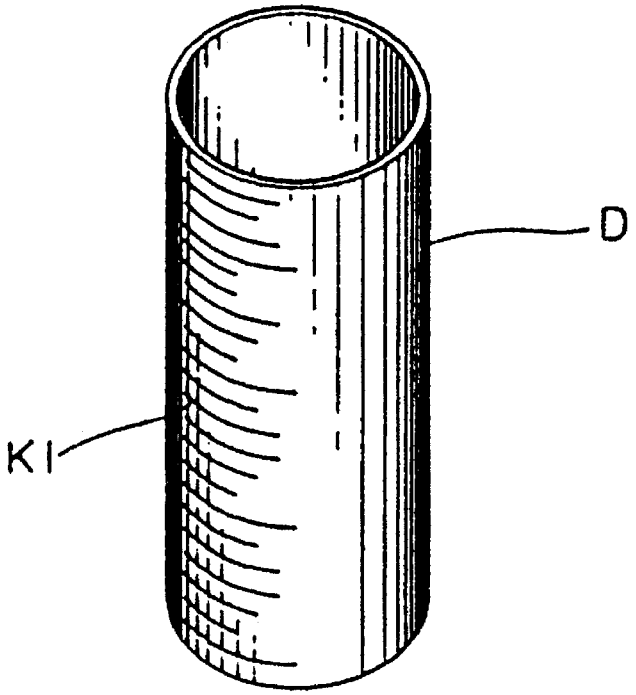
Figure 4A:
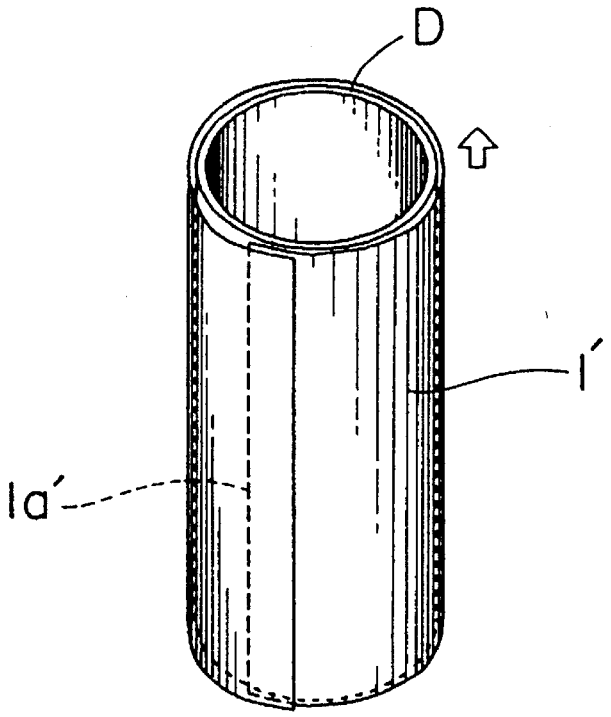
FIG. 4(*a*) is a perspective view illustrating an unpacking process in which a packing sheet wrapped around a photoreceptor with the edge portion thereof being unfolded is drawn from the photoreceptor in an axial direction of the photoreceptor, and FIG. 4(*b*) is a perspective view illustrating the photoreceptor whose surface is scratched by the packing sheet in the unpacking process.
Figure 4B:
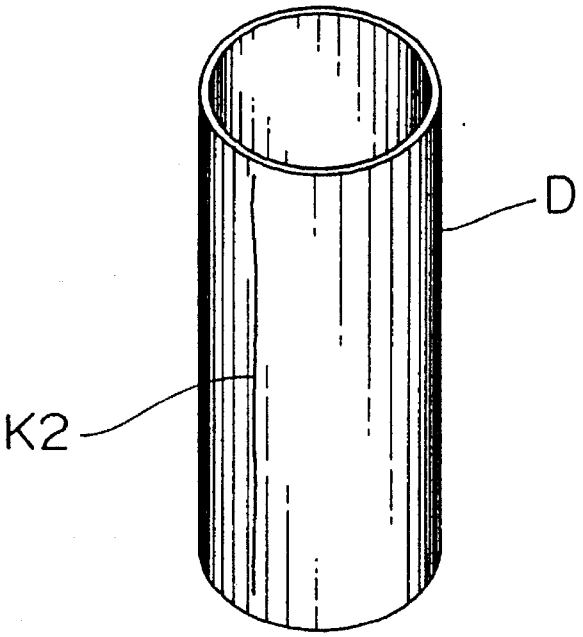

A wrapping-start edge portion la of a packing sheet 1 is folded across a width of the packing sheet 1 as shown in FIG. 1(*a*). A crease 1*b* thus formed is of an R-shape as shown in FIG. 2.

Then, the packing sheet 1 wraps the surface of the electrophotographic photoreceptor D such that the edge portion 1*a* folded along the crease 1*b* faces outward as shown in FIG. 1(*b*).

Next, a cushioning material such as an air mat wraps the packing sheet 1 in a conventional manner. Thus, the packing of the electrophotographic photoreceptor is completed.

In FIGS. 1(*a*) and 1(*b*), the packing sheet 1 covers an overall width of the photoreceptor D. In some cases, a photosensitive layer may not extend both ends on the surface of photoreceptor D. In these cases, the both ends require no light-shielding. Thus the width of the packing sheet 1 may be at least same as that of the photosensitive layer, or be slightly wider than that. That is, it does not necessarily require the overall width of the photoreceptor D.

Packing sheets to be used in the present invention preferably have an opacity in a range between 90% and 100% which is obtained from the following equation:

$$\text{Opacity (\%)} = \frac{R_W}{R_B} \times 100$$

where $R_W$ and $R_B$ are reflection densities of a packing sheet placed on white and black backgrounds, respectively. The reflective densities are measured by a reflection density meter, for example, Model No. TC-6DS available from Tokyo Denshoku Co., Ltd.

Packing sheets having an opacity lower than the aforementioned range can not provide a sufficient light-shielding properties, thus decreasing the photo-sensitivity of a photoreceptor.

It is desirable to use a thick paper showing the utmost opacity within the above range. Most preferred is a thick paper having the opacity of 100%.

More specifically, a black paper having a thickness in a range between 0.08 mm and 0.3 mm is appropriate.

If the thickness of a black paper is below the aforementioned range, its opacity becomes less than the aforesaid range, thus failing to provide a sufficient light-shielding properties. This may cause a decrease in photosensitivity of a photoreceptor. In a case where a black paper with a thickness greater than the aforementioned range wraps the circumferential surface of a photoreceptor in the packing process, there may be a gap between the photoreceptor and a wrapping-end edge portion of the paper overlapped along a wrapping-start edge portion outwardly folded, thereby allowing light to pass through the gap. This may cause the local decrease in photosensitivity of the photoreceptor.

Synthetic papers are unfit for the present invention, because they contain the plasticizer and the residual solvent as previously mentioned.

For packing sheets, there can employ normal papers made of paper pulp.

The packing process of the present invention can be suitably applied to the packing of electrophotographic photoreceptors such as the Se-Te photoreceptors and the organic photoreceptors as previously mentioned, whose surface hardness are relatively low, that is, a Vicker's hardness of 45 or less. Needless to say, it is applicable to those having a greater surface hardness.

Further, the above process can be suitably applied to the packing of such electrophotographic photoreceptors as having a small diameter (for example, 40 mmϕ or less) which may tend to impart warping to the packing sheet 1. It is applicable, of course, to those having a greater diameter.

EXAMPLES

The present invention will be detailed below by way of examples and comparative examples.

EXAMPLES 1 to 4

Organic photoreceptors (Vicker's hardness Hv=20) having respective drum diameters shown in Table 1 were respectively wrapped in a black paper, as a packing sheet 1, (thickness: 0.1 mm, basis weight: 80 g/m$^2$, opacity: 100%) with the wrapping-start edge portion 1*a* being outwardly folded as shown in FIG. 1(*a*), and then stored in a dark place under a high-temperature and high-humidity conditions (at a temperature of 50° C. and a humidity of 65%RH) for ten days. Thereafter, the respective photoreceptors were unpacked by drawing out the black paper therefrom in an axial direction thereof.

COMPARATIVE EXAMPLES 1 and 2

Organic photoreceptors (Vicker's hardness Hv=20) having respective drum diameters shown in Table 1 were respectively wrapped in the same black paper as used in EXAMPLES 1 to 4 without the wrapping-start edge portion being outwardly folded, and then stored in a dark place under the aforesaid high-temperature and high-humidity condition for ten days. Thereafter, the respective photoreceptors were unpacked by drawing out the black paper therefrom in an axial direction thereof.

COMPARATIVE EXAMPLE 3

An organic photoreceptor (Vicker's hardness Hv=20) having a drum diameter of 30 mmϕ was wrapped in a relatively thin black paper (thickness: 0.05 mm, basis weight: 40 g/m$^2$, opacity: 70%) without the wrapping-start edge portion thereof being outwardly folded, and then was stored in a dark place under the aforesaid high-temperature and high-humidity conditions for ten days. Thereafter, the photoreceptor was unpacked by drawing out the black paper therefrom in an axial direction thereof.

The following evaluation tests were carried out for EXAMPLES 1 to 4 and COMPARATIVE EXAMPLES 1 to 3.

Evaluation of black papers' warp

The degree of the respective black papers' warp was evaluated by the radius of curvature measured after the unpacking process.

Observation of scratches formed on photoreceptors' surfaces

Surface roughness for each photoreceptor was measured by a surface roughness tester for checking the presence or absence of scratches and, if any, for measuring its depth.

Evaluation of formed images

The respective photoreceptors after being unpacked were respectively installed in an electrostatic copying machine (Model No. CC-50 available from Mita Industrial Co., Ltd.), by which a gray document was copied. The copy images thus formed were visually inspected for checking the presence of any image defects and, if any, for identifying the kind of the image defects.

Table 1 shows the evaluation test results.

TABLE 1

| | Drum diameter (mmϕ) | Warp of black paper (mm) | Photoreceptor's Scratches Presence/Depth | | Image defects |
|---|---|---|---|---|---|
| EXAMPLE 1 | 50 | 50 | No | — | No |
| EXAMPLE 2 | 40 | 30 | No | — | No |
| EXAMPLE 3 | 30 | 20 | No | — | No |
| EXAMPLE 4 | 25 | 15 | No | — | No |
| COMP. EX. 1 | 40 | 30 | Yes | 7 μm | White-line |
| COMP. EX. 2 | 30 | 20 | Yes | 10 μm | White-line |
| COMP. EX. 3 | 30 | 40 | No | — | No |

Followings are noted from the results in Table 1.

In COMPARATIVE EXAMPLES 1 and 2 in which the black paper was wrapped around the photoreceptors without the wrapping-start edge portion of the paper being outwardly folded, there formed scratches even on the photoreceptor with a relatively large diameter of 40 mmϕ.

On the other hand, in EXAMPLES 1 to 4 in which the black paper was wrapped around the photoreceptors with the wrapping-start edge portion being outwardly folded, no scratch was formed even on the photoreceptor with a relatively small diameter of 25 mmϕ.

This proves that the packing process of the present invention is valid for organic photoreceptors whose surface are soft.

In COMPARATIVE EXAMPLE 3 using a relatively thin black paper, no scratch was formed on the surface of the photoreceptor even though the wrapping-start edge portion was not outwardly folded.

The following light-shielding test was carried out for COMPARATIVE EXAMPLE 3 and EXAMPLE 3 (each having a drum diameter of 30 mmϕ) to evaluate the light-shielding properties.

Light-shielding test

A white light with a light intensity of 1000 Lux was irradiated to the packed photoreceptors of EXAMPLE 3 and COMPARATIVE EXAMPLE 3 for 15 minutes. Thereafter, the photoreceptors were unpacked, and the residual potential Vr'(V) on the surface of the respective photoreceptors was measured by a drum photo-sensitivity tester (available from Genteck Corporation) in accordance with the following procedure. Then, a change ΔRP(V) for the residual potential was obtained from the following equation using the residual potential Vr'(V) thus measured and a residual potential Vr(V) measured before the light exposure in the following manner.

$$\Delta RP\ (V) = Vr'\ (V) - Vr\ (V)$$

From the values thus obtained, the decrease in photosensitivity of the photoreceptors was determined to judge the light-shielding properties of the black paper.

Measurement of residual potentials

The unpacked photoreceptors were respectively mounted on the aforesaid drum photosensitivity tester, and the surface of each photoreceptor was electrically charged by applying a voltage. In this state, a white light with a light intensity of 50 Lux was irradiated thereto for 0.06 seconds. Then, the surface potential was measured at which 0.5 seconds lapsed from the start of the light exposure to obtain the residual potentials Vr(V) and Vr'(V).

Table 2 shows the result of the light-shielding test.

TABLE 2

| | Black paper | | ΔRP |
|---|---|---|---|
| | Thickness (mm)/ | Opacity (%) | (V) |
| EXAMPLE 3 | 0.1 | 100 | ±0 |
| COMP. EX. 3 | 0.05 | 70 | +30 |

As can be seen from Table 2, the relatively thin black paper used in COMPARATIVE EXAMPLE 3 did not provide a perfect light-shielding for the photoreceptor, thus causing the light deterioration.

On the other hand, the relatively thick black paper used in EXAMPLE 3 provided a perfect light-shielding for the photoreceptor, thereby reliably preventing the light deterioration.

EXAMPLE 5

An Se-Te photoreceptor (Vicker's hardness Hv=45) having a drum diameter of 40 mmϕ was wrapped in a black paper (thickness: 0.1 mm, basis weight: 80 g/m$^2$, opacity: 100%) with the wrapping-start edge portion la being outwardly folded as shown in FIG. 1(*a*), and then was stored in a dark place under a high-temperature and high-humidity conditions (at a temperature of 50° C. and a humidity of 65%RH) for ten days. Thereafter, the photoreceptor was unpacked by drawing out the black paper therefrom in an axial direction thereof.

COMPARATIVE EXAMPLES 4 and 5

Se-Te photoreceptors (Vicker's hardness Hv=45) having respective drum diameters shown in Table 3 were respectively wrapped with the same black paper used in EXAMPLE 5 without the wrapping-start edge portion being outwardly folded, and then were stored in a dark place under the aforesaid high-temperature and high-humidity conditions for ten days. Thereafter, the respective photoreceptors were unpacked by drawing out the black paper therefrom in an axial direction thereof.

The above mentioned tests were carried out for EXAMPLE 5 and COMPARATIVE EXAMPLES 4 and 5.

Table 3 shows the evaluation test results.

TABLE 3

| | Drum diameter (mmϕ) | Warp of black paper (mm) | Photoreceptor's Scratches Presence/Depth | | Image defects |
|---|---|---|---|---|---|
| EXAMPLE 5 | 40 | 30 | No | — | No |
| COMP. EX. 4 | 40 | 30 | Yes | 6 μm | White-line |
| COMP. EX. 5 | 30 | 20 | Yes | 8 μm | White-line |

Followings are noted by inspection of Table 3.

In COMPARATIVE EXAMPLES 4 and 5 in which the black papers were wrapped around the photoreceptors without the wrapping-start edge portion being outwardly folded, there formed scratches even on the photoreceptor with a relatively large drum diameter of 40 mmϕ.

On the other hand, in EXAMPLE 5 in which the black paper was wrapped around the photoreceptor with the wrapping-start edge portion being outwardly folded, no scratch was formed on the photoreceptor having a diameter of 40 mmϕ, which was same as COMPARATIVE EXAMPLE 4.

This proves that the packing process of the present invention is also valid for the Se-Te photoreceptors.

EXAMPLES 6–7 and COMPARATIVE EXAMPLE 6

Using black papers each having the thickness described in Table 4, as a packing sheet 1, organic photoreceptors (Vicker's hardness Hv=20) having a drum diameter of 30 mmϕ were wrapped with the wrapping-start edge portion 1*a* being outwardly folded as shown in FIG. 1(*a*).

Figure 5:
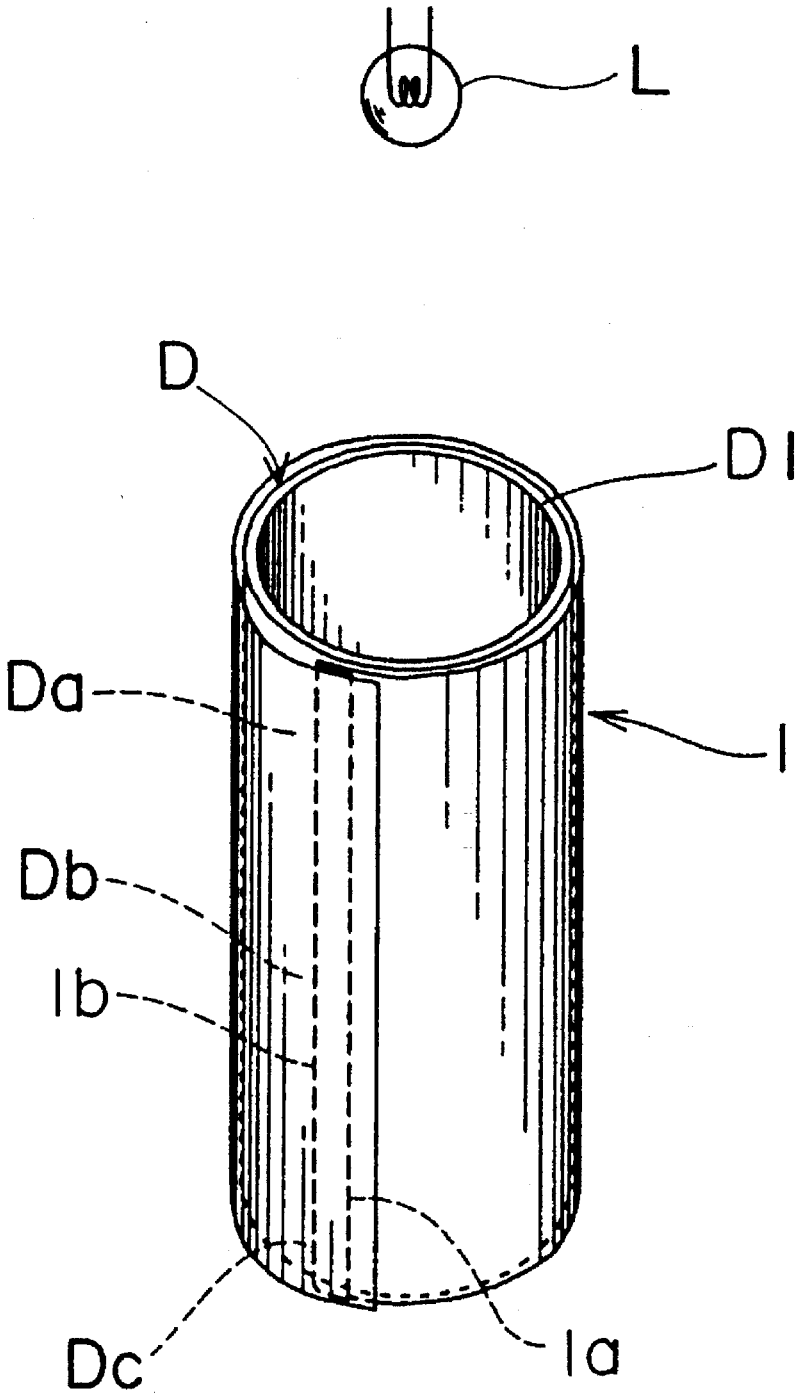
FIG. 5 is a perspective view illustrating a typical method of evaluating the light-shielding properties of packing sheets.

As shown in FIG. 5, a photoreceptor D wrapped in the aforesaid black paper was exposed for 15 minutes to a white light emitted by a light source L, which was disposed on an axis of the photoreceptor D spaced apart by 50 cm from one end portion D1 of the photoreceptor D, such that the light intensity on the end portion D1 was 1000 Lux. Thereafter, the photoreceptors thus exposed were unpacked.

The residual potentials on the surface of the respective organic photoreceptors were measured before and after the light exposure in the same manner as the aforesaid light-shielding test to obtain a difference ΔRp.

The measuring points were located at a point Da on the side of the end portion D1 closer to the light source L, at a point Db intermediate the width of the photoreceptor D, and at a point Dc on the side of the end portion farther from the light source L along the overlapped edge portions of the packing sheet 1 wrapped around the photoreceptor.

Table 4 shows the results, accompanying those of EXAMPLE 3 and COMPARATIVE EXAMPLE 3 using black papers having different thicknesses.

TABLE 4

| | Black paper | | | ΔRP (V) | | |
|---|---|---|---|---|---|---|
| | Thickness/ (mm) | Basis weight/ ($g/m^2$) | Opacity (%) | Da | Db | Dc |
| COMP. EX. 3 | 0.05 | 40 | 70 | +30 | +25 | +20 |
| EXAMPLE 6 | 0.08 | 64 | 90 | ±0 | ±0 | ±0 |
| EXAMPLE 3 | 0.10 | 80 | 100 | ±0 | ±0 | ±0 |
| EXAMPLE 7 | 0.30 | 240 | 100 | ±0 | ±0 | ±0 |
| COMP. EX. 6 | 0.50 | 400 | 100 | +30 | ±0 | ±0 |

Followings are noted by inspection of Table 4.

The black paper having a thickness of 0.08 mm or greater and an opacity of 90% or higher perfectly shielded the photoreceptors from light, in contrast with the relatively thin black paper used in COMPARATIVE EXAMPLE 3, thereby reliably preventing the light deterioration of the photoreceptors.

In COMPARATIVE EXAMPLE 6 using the black paper having a thickness greater than 0.3 mm, there occurred a local light deterioration of the photoreceptor at the point Da on the side of the end portion D1 closer to the light source L. This was caused by the light passed through the gap along the overlapped edge portions of the black paper wrapped around the photoreceptor.

EXAMPLES 8–10 and COMPARATIVE EXAMPLES 7–8

Organic photoreceptors having a drum diameter 78 mmϕ were respectively packed and the respective values of residual potential ΔRP at three measuring points were obtained in the same manner as in EXAMPLES 3, 6, 7 and COMPARATIVE EXAMPLES 3 and 6.

Table 5 shows the result of the light-shielding test.

TABLE 5

| | Black paper | | | ΔRP (V) | | |
|---|---|---|---|---|---|---|
| | Thickness/ (mm) | Basis weight/ ($g/m^2$) | Opacity (%) | Da | Db | Dc |
| COMP. EX. 7 | 0.05 | 40 | 70 | +30 | +25 | +20 |
| EXAMPLE 8 | 0.08 | 64 | 90 | ±0 | ±0 | ±0 |
| EXAMPLE 9 | 0.10 | 80 | 100 | ±0 | ±0 | ±0 |
| EXAMPLE 10 | 0.30 | 240 | 100 | ±0 | ±0 | ±0 |
| COMP. EX. 8 | 0.50 | 400 | 100 | +30 | ±0 | ±0 |

As can be seen from Table 5, even for a larger drum diameter, the black paper having a thickness of 0.08 mm to 0.3 mm and an opacity of 90% or higher perfectly shielded the photoreceptors from light, in contrast with the relatively thin black paper used in COMPARATIVE EXAMPLE 7, thereby reliably preventing the light deterioration.

In addition, no local light deterioration occurred owing to no gap along the overlapped edge portions, unlike COMPARATIVE EXAMPLE 8 using the relatively thick black paper.

What is claimed is:

1. A process for packing a drum-shaped electrophotographic photoreceptor, comprising the steps of:

folding a wrapping-start edge portion of a light-shielding packing sheet outwardly in a diametrical direction of the electrophotographic photoreceptor across a width of the packing sheet to prevent physical damage to said photorecptor by said wrapping-start edge portion of said packing sheet; and wrapping the packing sheet on a circumferential surface of the electrophotographic photoreceptor.

2. A process for packing an electrophotographic photoreceptor as set forth in claim 1, wherein said packing sheet has an opacity in a range between 90% and 100% which is calculated from the following equation:

$$\text{Opacity (\%)} = \frac{R_W}{R_B} \times 100$$

where $R_W$ and $R_B$ are reflection densities of the packing sheet placed on white and black backgrounds, respectively.

3. A process for packing an electrophotographic photoreceptor as set forth in claim 2, wherein said packing sheet is a black paper having a thickness of 0.08 mm to 0.3 mm.

4. A process for packing an electrophotographic photoreceptor as set forth in claim 1, wherein said electrophotographic photoreceptor has a Vicker's hardness of 45 or less.

5. A process for packing an electrophotographic photoreceptor as set forth in claim 1, wherein said electrophotographic photoreceptor has a diameter of 40 mmϕ or less.

* * * * *